United States Patent [19]

Barnabie

[11] Patent Number: 4,937,897

[45] Date of Patent: Jul. 3, 1990

[54] KNEELING PAD FOR BATHTUBS

[76] Inventor: Albert Barnabie, 47 S. Lakeview Dr., Gibbsboro, N.J. 08026

[21] Appl. No.: 393,253

[22] Filed: Aug. 14, 1989

[51] Int. Cl.[5] ..... A47K 3/02

[52] U.S. Cl. ..... 4/580; 297/187; 4/559

[58] Field of Search ..... 4/555, 559, 560, 571, 4/574, 578, 576, 579, 580, 581, 661; 297/187, 426, 423

[56] References Cited

U.S. PATENT DOCUMENTS

| | | | |
|---|---|---|---|
| D. 35,304 | 11/1901 | Pendergast | 4/574 |
| 4,356,575 | 11/1982 | Terry | 4/576 |
| 4,385,408 | 5/1983 | Rhodes | 4/579 |

*Primary Examiner*—Henry J. Recla
*Assistant Examiner*—Glenn T. Barrott
*Attorney, Agent, or Firm*—Millman & Jacobs

[57] ABSTRACT

A kneeling pad for use at bathtubs includes a water resistant sheeting and a plurality of cushions secured to said sheeting at spaced portions for kneeling and leaning on and so as to be foldable and having a pocket for holding articles used in the bath.

6 Claims, 2 Drawing Sheets

KNEELING PAD FOR BATHTUBS

BACKGROUND OF THE INVENTION

This invention relates to a kneeling pad to be placed on a bathtub to enable a person to kneel at the tub and bathe a child or an invalid in the tub.

A prior kneeling appliance for use at a bathtub is shown in U.S. Pat. No. 4,356,575 of Terry which employs a framework that positions a pad at the using person's knees and another at the upper torso.

SUMMARY OF THE INVENTION

It is among the objects of this invention to provide a new and improved kneeling pad for a bathtub.

Another object is to provide a new and improved kneeling pad for a bathtub that is easy and comfortable to use and convenient to store when not in use.

Another object is to provide a new and improved kneeling pad for a bathtub that is inexpensive to construct.

In accordance with an embodiment of this invention, a kneeling pad for a floor mounted bathtub comprises a water resistant sheeting and a plurality of cushions attached to spaced parts of said sheeting and covered thereby. The sheeting is of length sufficient to have a first section extending over the top side of the bathtub, a second section extending down from the top section and over the inside of the bathtub, a third section extending down from the top part and over the outside of the bathtub and a fourth section extending from the third section and over the floor area adjacent to the bathtub. A plurality of cushions are attached to the sheeting, one at the top section to provide an arm rest for a kneeling user, and another cushion at the floor section to provide a knee rest for the user. The sheeting is foldable adjacent said cushions to enable compact storage thereof.

BRIEF DESCRIPTION OF THE DRAWING

The foregoing and other objects of this invention as well as the various features thereof will be more readily understood from the following detailed description when read together with the accompanying drawing, in which.

DETAILED DESCRIPTION OF THE INVENTION

Figure 1:
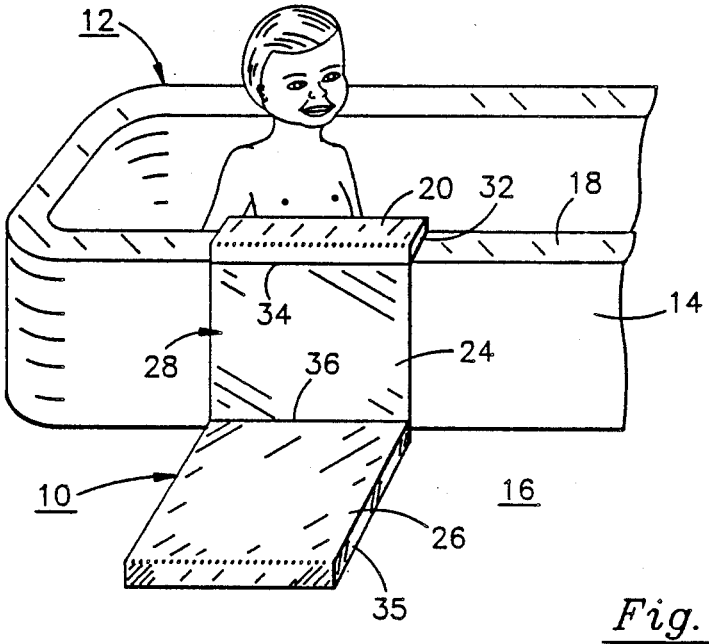
FIG. 1 is a perspective view from outside a bathtub of a kneeling pad embodying this invention and mounted on the bathtub for use in bathing a child sitting or standing in the tub.

In the drawing corresponding parts are referenced throughout by similar numerals.

In the embodiment of FIGS. 1 to 6, the kneeling pad 10 is illustrated in use with a bathtub 12 of contemporary design, generally rectangular in shape and with a vertical outside wall 14 whose lower edge is flush with the floor 16 and whose upper edge is along a generally horizontal ledge 18.

The kneeling pad 10 is formed in four sections: a top section 20 that rests on tub ledge 18, an inside-the-tub section 22, an outside-wall section 24 and a floor section 26. The sections are interconnected by a length of water resistant sheeting 28 that extends from the inside section 22 to the floor section 26. The sheeting 28, preferably made of a waterproof material such as vinyl, may be a continuous sheet that includes portions forming hinges that extend transversely of the sheeting and respectively pivotally connect together adjacent sections of the kneeling pad. More specifically, hinge 36 connects together floor section 26 and outside-the-tub section 24; hinge 34 connects together outside-the-tub section 24 and top section 20; and another hinge 37 (FIG. 2) connects together top section 20 and inside-the-tub section 22. These hinges extend across the entire width of the sheeting 28.

Figure 2:
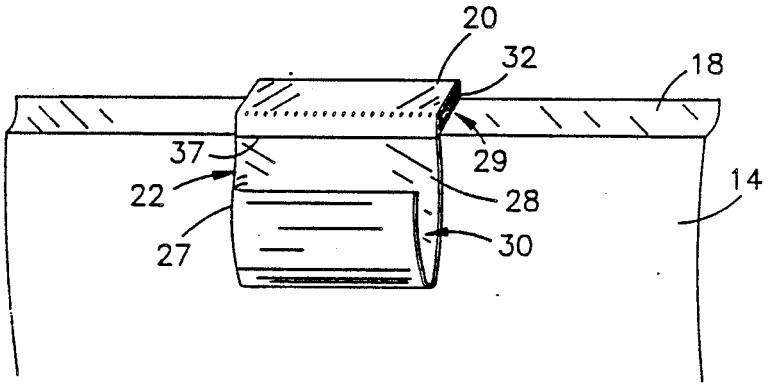
FIG. 2 is a perspective view from inside the bathtub with parts cut away of the kneeling pad of FIG. 1.
Figure 3:
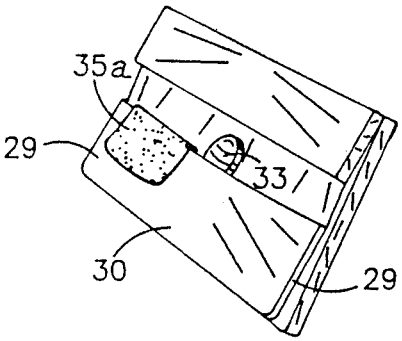
FIG. 3 is a perspective view of the kneeling pad of FIGS. 1 and 2 in folded condition and as viewed from the section inside the tub and the top cushion section.

In one form of the invention, the sheeting is folded in double sections to form different parts of the pad. Thus, the sheet 28 is folded double at the inside-the tub section 22 and bounded or stitched at its side edges, as shown at 27 in FIGS. 2 and 3, to form a pouch 30 that can hold soap 33 and a wash cloth 35. The bottom of the pouch is preferably perforated to pass the water splashed in from the tub. As shown in FIGS. 1 and 2, a cushion 32 about the width of the rim 18 of the tub is inserted in a double-fold pocket 29 formed in the sheeting 28 at the top section 20. A single connection for that pocket located adjacent the hinge 34 may be formed with the cushion section resting in use on the sheeting; alternatively, the pocket may be connected to the sheeting 28 at both sides of the top cushion section 20.

The vertical, outside section 24 may be a section of sheeting 28, or double sheet, or a double sheet with cushion inserted. The floor section 26 is formed as a pocket with a thick slab 35 of cushion material suitable for bearing the weight of the user. A single hinge 36 at the connection between sections 24 and 26 is formed in the vinyl sheeting 28. Bonding or stitching of the sheeting forms hinges that are effective. The top cushion 32 and the pocket 29 for it are slightly wider than the tub rim or ledge 18 so that this cushioning extends around the edge of the ledge and serves to cushion the user's upper torso which tends at times during the bath to bear against that edge.

Figure 4:
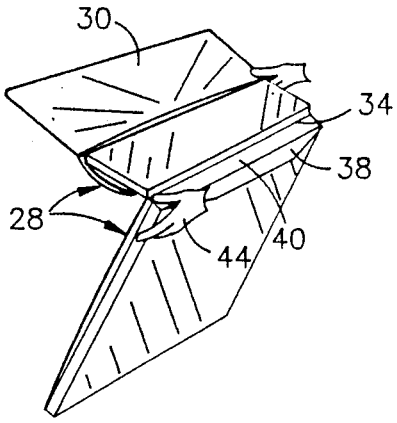
FIG. 4 is a perspective view from outside the tub of the kneeling pad of FIG. 3 partly unfolded.
Figure 5:
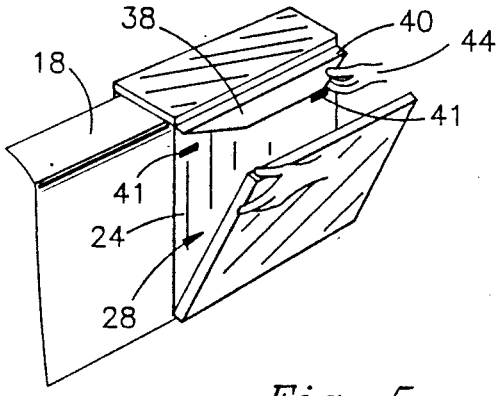
FIG. 5 is a perspective view from outside the tub of the kneeling pad of FIG. 4 with the floor cushion partially folded.
Figure 6:
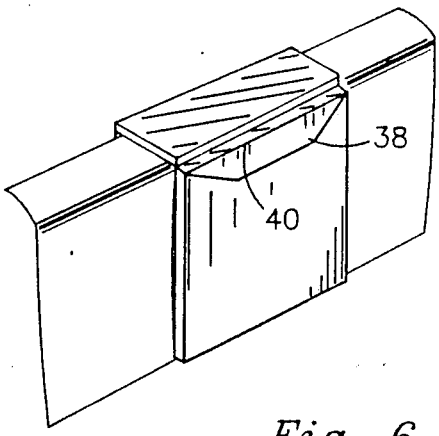
FIG. 6 is a perspective view from outside the tub of the kneeling pad of FIG. 5 with the floor cushion folded.

A thickened projecting double-fold 38, 40 of sheeting 28 in outside section 24 is formed at the hinge 34 (FIGS. 4–6). This double fold includes a flap 38 at its outer end and, at its inner end, a band 40 of sheeting of width slightly greater than the thickness of the floor cushion 35. The band 40 positions the flap 38 to overlap and retain the floor cushion 35 in the enfolded and storage position when the floor cushion is folded into a vertical position; as indicated by the user's hand 44 in FIGS. 4 and 5.

In one embodiment of the invention, mating Velcro pads 41 on the wall 24 and the knee pad 26 are used to hold the knee pad in its folded position against wall 24.

Figure 7:
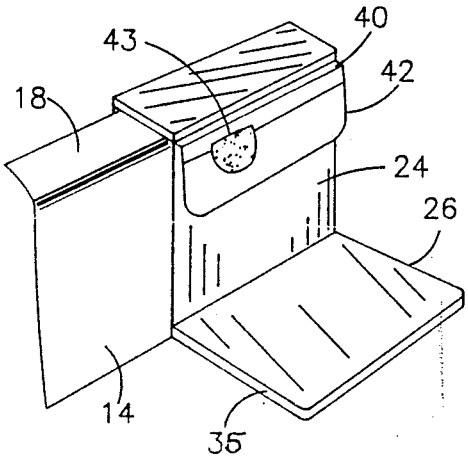
FIG. 7 is a perspective view from outside the tub of a modification of the kneeling pad of FIG. 5.

In a modification of the invention shown in FIG. 7, an outside pouch 42 is formed in a fold of the vertical wall 24 of sheeting 28. This pouch 42 is connected to wall 24 in the same manner as the flap 38 of FIGS. 5 and 6. Pouch 42 can be used to hold toys or other articles used during the bath, such as a wash cloth 43, and can also retain the knee pad in a folded storage condition. In this latter respect, the pouch 42 is pivoted upwardly in the same manner as flap 38 of FIGS. 5 and 6 can be pivoted, the knee pad 26, 35 is folded upwardly into a vertical position, with its top edge beneath the pouch 42, and the pouch 42 is pivoted downwardly over this top edge.

In use, an adult can kneel on the knee pad 26, 35 at the side of the tub 14 and lean on the arm pad 20 along the rim 18 of the tub. The two pads are held guided in parallel alignment by the connecting sheet 24. The pouch 30 hangs from the arm pad 20 into the tub where it is generally accessible. The interconnected parts can be readily folded up for storage and unfolded and reassembled for use.

While 1 have shown and described a particular embodiment of my invention, it will be obvious to those skilled in the art that various changes and modifications may be made without departing from my invention in its broader aspects; and I, therefore, intend herein to cover all such changes and modifications as fall within the true spirit and scope of my invention.

What is claimed is:

1. A kneeling pad for a bathtub having a top side, an inside and an outside, said kneeling pad comprising:

water resistant flexible sheeting, a plurality of cushions spacedly attached to said sheeting;

said sheeting being of length sufficient to have a first part extending over a portion of the top side of said bathtub, a second part extending down over a portion of the inside of said bathtub, a third part extending over a portion of the outside thereof, and a fourth part extending over a portion of the floor area adjacent to said bathtub, one of said cushions being attached to said sheeting at said first part to provide an arm rest for a kneeling user, another of said cushions being attached to said sheeting at said fourth part to provide a knee rest for the user, said sheeting being foldable in said third part thereof, and said sheeting including hinges along which said kneeling pad can be folded into a flattened condition.

2. A kneeling pad as recited in claim 1 in which when the kneeling pad is folded into said flattened condition, said first and second parts are disposed adjacent said third part at one side of the third part and said fourth part is disposed adjacent said third part at the other side of said third part.

3. A kneeling pad as recited in claim 2 in which when the kneeling pad is folded into said flattened condition, said parts are disposed in superimposed layers.

4. A kneeling pad as recited in claim 1 and further comprising a pouch formed on said sheeting at the second part thereof and having drainage openings to pass water into the bathtub.

5. A kneeling pad as recited in claim 1 and further comprising a pouch formed on said sheeting at the third part thereof.

6. A kneeling pad as recited in claim 5 wherein said pouch at the third part envelops and retains said knee rest when in said flattened condition.

* * * * *